US006435767B1

(12) United States Patent
Steffen

(10) Patent No.: US 6,435,767 B1
(45) Date of Patent: Aug. 20, 2002

(54) DIRECTIONAL CONTROLS FOR VIBRATING PLATE

(75) Inventor: Michael Steffen, Stockdorf (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/646,234

(22) PCT Filed: Mar. 1, 1999

(86) PCT No.: PCT/EP99/01311

§ 371 (c)(1),
(2), (4) Date: Sep. 7, 2000

(87) PCT Pub. No.: WO99/47754

PCT Pub. Date: Sep. 23, 1999

(30) Foreign Application Priority Data

Mar. 16, 1998 (DE) ..... 198 11 345

(51) Int. Cl.[7] ..... E01C 19/30
(52) U.S. Cl. ..... 404/133.1; 404/133.05
(58) Field of Search ..... 404/133.05, 133.1

(56) References Cited

U.S. PATENT DOCUMENTS 3,073,219 A * 1/1963 Miller ..... 404/133.1
3,109,354 A * 11/1963 van Kirk ..... 404/133.1
3,283,677 A 11/1966 Uebel et al. ..... 94/48
3,603,225 A * 9/1971 Buck ..... 404/133.1
3,694,018 A * 9/1972 Levering ..... 293/121
3,782,845 A * 1/1974 Briggs et al. ..... 404/133.05
3,802,791 A 4/1974 Uebel et al. ..... 404/133
4,425,980 A * 1/1984 Miles ..... 181/208
4,643,611 A * 2/1987 Pilachowski ..... 404/133.05
4,775,263 A * 10/1988 Persson et al. ..... 404/133.05
4,954,375 A * 9/1990 Sattinger et al. ..... 428/34.1
5,387,370 A * 2/1995 Tomizawa et al. ..... 252/299.01
5,547,049 A * 8/1996 Weiss et al. ..... 188/267
5,672,027 A * 9/1997 Wadensten ..... 404/133.05
6,213,681 B1 * 4/2001 Sick et al. ..... 404/133.05

FOREIGN PATENT DOCUMENTS

DE 197 31 731 * 2/1999

* cited by examiner

*Primary Examiner*—Gary S. Hartmann
(74) *Attorney, Agent, or Firm*—Boyle Fredrickson Newholm Stein & Gratz S.C.

(57) ABSTRACT

A vibrating plate consists of an upper mass with a drive unit and a lower mass with a ground contact plate and a vibration exciter. The upper mass and lower mass are coupled with each other at several points with spring-and-damper units. According to the invention, the spring properties and/or damping properties of the particular spring-and-damper unit in at least one of these points can be modified via a steering device which makes it possible to steer the vibrating plate.

12 Claims, 2 Drawing Sheets

DIRECTIONAL CONTROLS FOR VIBRATING PLATE

BACKGROUND OF THE INVENTION

1. Field of the Invention

The invention pertains to a ground compaction device.

2. Description of the Related Art

These types of vibration plates commonly consist of an upper mass that has a drive unit and a lower mass that consists essentially of a ground contact plate and an oscillator unit. In this oscillator unit there are commonly one, two, or four imbalance exciters that are arranged on one or two exciter shafts driven by the drive unit. The upper mass is coupled at a number of places to the lower mass through spring-damper units, e.g. rubber bumpers. By rotating the exciter shafts, forces are produced that lift the ground contact plate in intervals and—if the exciter is configured correctly—shift it a bit in the direction desired by the user. In this way, the vibration plate not only can be moved forward and backward, but also can be steered.

Small vibration plates are steered by the user using a center pole, which can be done by the user applying force as required; this is due to the relatively low weight of the vibration plate. For larger vibration plates, on the other hand, the steering is done using the oscillator. In this arrangement, imbalance forces are distributed along the axial direction of the exciter shaft, i.e. on the right and left halves of the lower mass. By activating a switch at the center pole, a hydraulic mechanism is activated that influences the position of the centrifugal weights relative to one another such that asymmetrical force vectors act on the ground contact plate, resulting in a yaw moment being produced about the vertical axis of the machine, which then steers the machine.

Especially for larger vibration plates, but for smaller plates as well, the steering ability either requires a lot of force on the part of the user or is only mechanically possible by using expensive hydraulics.

From DE-B-1 168 350, a ground compaction device is known that has a lower mass containing a ground contact plate and an oscillator unit, and that has spring units that couple the upper mass to the lower mass at a number of places. The spring tension of the spring units is changed using piston-cylinder units at the upper mass associated with each. This allows the ground pressure force of the ground contact plate to be adjusted. The upper mass is essentially made up of a steamroller.

EP-A-0 142 198 shows a comparable ground compaction device in which the spring tension on the spring units can also be shifted by a piston-cylinder unit to change the surface pressure of the ground contact plate.

From U.S. Pat No. 3,802,791, a ground compaction device is known that has an upper mass containing an oscillator unit and a lower mass having a ground contact plate. The oscillations produced at the upper mass are transferred through an intermediate plate and through spring units to the lower mass. Between the intermediate plate belonging to the upper mass and the lower mass are additional spring-damper units installed at a number of places, whose spring tension can be changed by tilting the upper mass in the forward or backward direction of travel. Steering the ground compaction device is done by merely pulling on a guide bracket.

OBJECTS AND SUMMARY OF THE INVENTION

The objective of the invention is to provide a vibration plate with a directional control system that is a simple design but also very effective.

It has been shown that by changing the damping characteristics or parameters of at least one damping element, which can be located on the right or left side of the vibration plate, asymmetrically with respect to the direction of travel, a yaw moment about the vertical axis of the plate is produced so that the plate turns in a direction accordingly. Changing the spring or damping characteristics using the steering device can thus turn the vibration plate into any desired direction accordingly during operation by the user.

In a preferred embodiment form of the invention, at least one spring-damper unit has a damping material made of viscoelectric liquid that can be subjected to a variable electric voltage by the steering unit. When using a viscoelectric liquid in a damper, it is possible to vary the damping characteristics from completely non-damping to rigid and thus adjust the damping value as desired, depending on the voltage applied.

Preferably, one or more of these types of damper are used together with rubber bumpers that couple the upper mass to the lower mass in a known fashion. In this regard, the viscoelectric dampers are arranged parallel to the rubber bumpers.

In another advantageous embodiment form, the damping characteristics of a selected rubber bumper is changed by providing a rod that can be moved into or out of the rubber bumper by means of a servomechanism controlled by the steering unit.

Again, another embodiment form of the invention is characterized in that the spring-damper unit whose spring and/or damping characteristics can be changed, has a number of springs and/or dampers that can be individually turned on or off by the steering unit by means of a servomechanism. This makes it possible, for example, to vary the position at which the rubber bumpers are coupled to the lower or upper mass by interposing springs or other rubber bumpers. Likewise, it is also possible to completely bypass individual rubber bumpers using a magnetic latch, or to switch in another rubber bumper.

BRIEF DESCRIPTION OF THE DRAWINGS

These and other features and advantages are explained in more detail below with reference to the figures and with the help of embodiment examples. In the drawings.

DETAILED DESCRIPTION OF THE PREFERRED EMBODIMENTS

Figure 1:
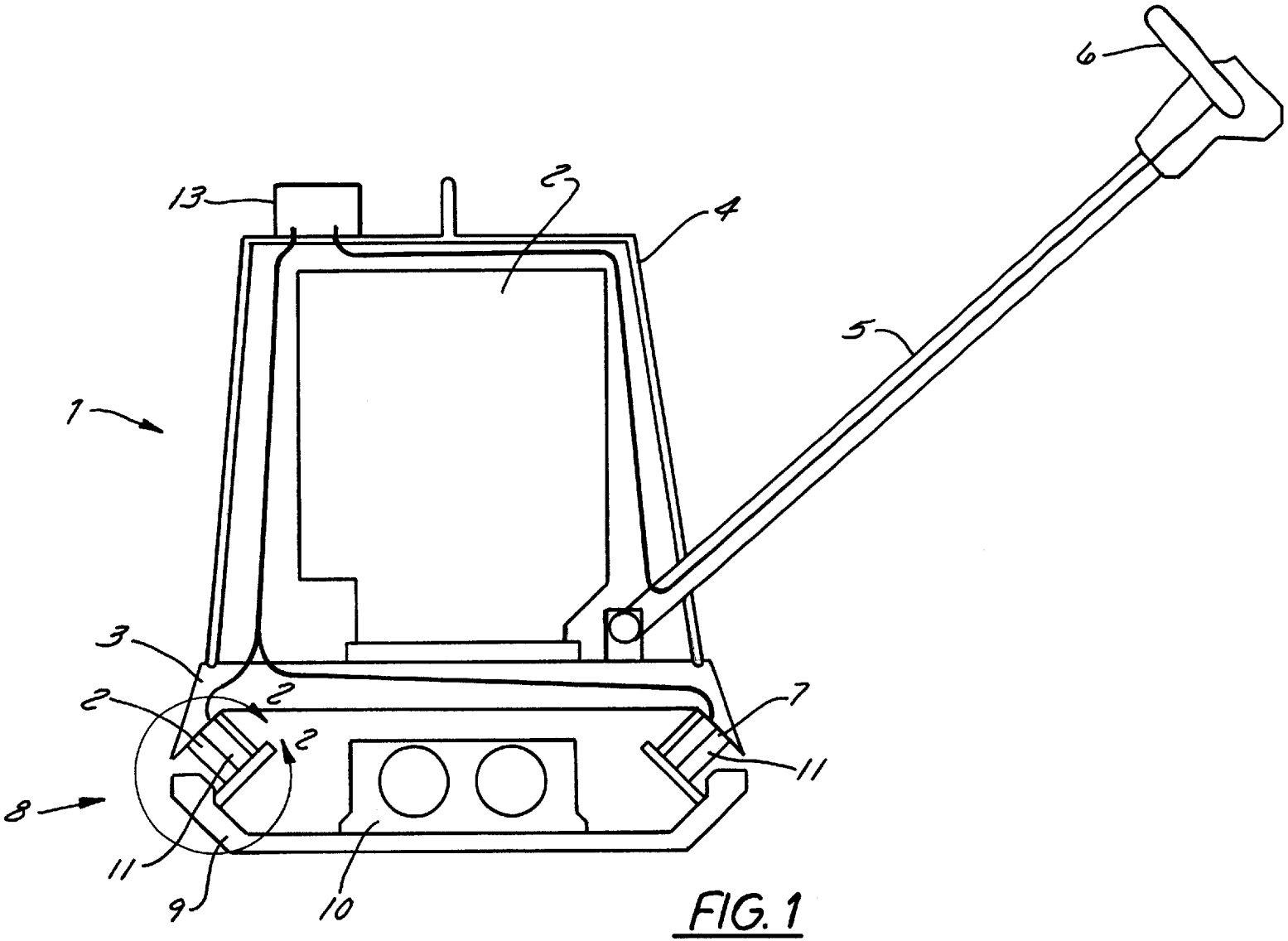
FIG. 1 shows schematically a side view of a vibration plate according to the invention.

An upper mass 1 consists essentially of a drive unit 2 that is fastened to a frame 3 and is covered by a protective frame 4. At frame 3 is a center pole guide 5 with a steering lever 6 attached to it.

The upper mass 1 is fastened at its frame 3 to a lower mass 8, which essentially consists of a ground contact plate 9 and an oscillator unit 10, using a number of rubber bumpers 7 (usually four). Since the oscillator unit 10 as well as the drive unit 2 that drives it are known, their detailed descriptions will be left out.

Figure 2:
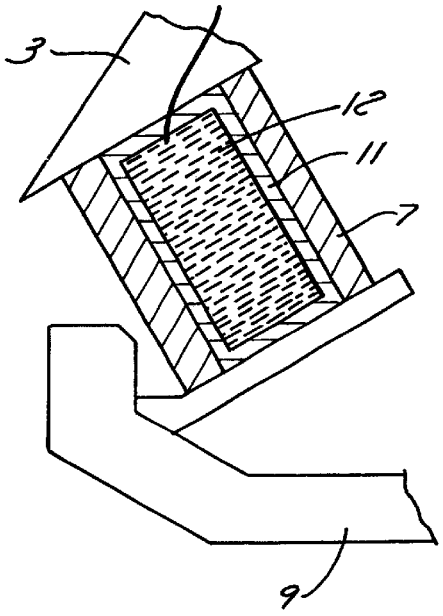
FIG. 2 is a somewhat schematic side sectional elevation view of a damping element of the vibration plate of FIG. 1.

The rubber bumpers 7 are usually placed between the frame 3 and the ground contact plate 9. Shown in FIGS. 1 and 2 are one or more damping elements 11 that contain a viscoelectric fluid 12 (e.g. RHEOBAY) as a damping material. Viscoelectric fluids are characterized in that their viscosity can be varied depending on an applied voltage. So, it is possible, for example, to let the viscoelectric fluid in the damper flow nearly resistance free, in which case the damping effect is minimal. On the other hand, the viscosity can be also greatly increased by applying a voltage, which results in an increase in the damping effect. The change in voltage applied to the viscoelectric damper is affected by activating the steering lever 6, which is connected to a suitable control element 13. The control element 13 is connected to the damping element 11 and produces and varies the voltage in the desired manner.

The change in voltage applied to the viscoelectric damper is affected by activating the steering lever 6, which is connected to a suitable control element, not shown. The control element produces and varies the voltage in the desired manner.

Especially preferable is an embodiment form shown in FIGS. 1 and 2 in which on both sides, i.e. left and right as seen in the direction of travel, at least one viscoelectric damper 11 is located. The fluids 12 in both dampers 11 change their viscosity by appropriately activating the steering level 6 and control element 13 so that different damping effects are produced on the two sides, producing the desired yaw moment about the vertical axis of the vibration plate 9.

Figure 3:
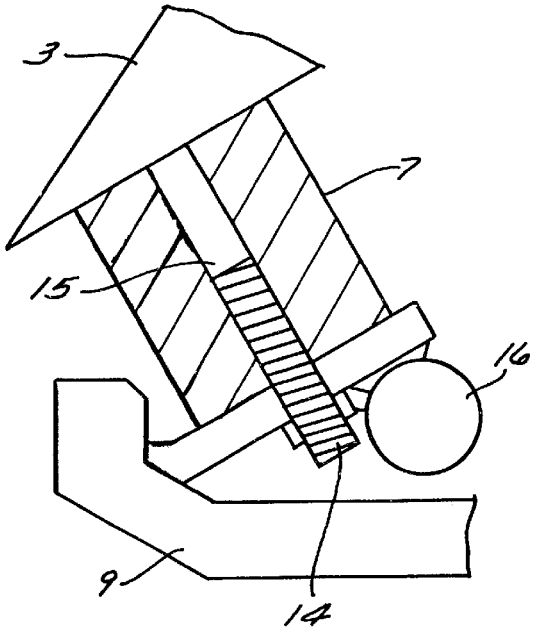
FIG. 3 is a somewhat schematic side sectional elevation view of a damping element constructed in accordance with another embodiment of the invention.

Alternative to the use of viscoelectric dampers 11, mechanical influences can also effect a change in the damper characteristics. So, for example, it is possible to screw a threaded rod 14 into a bore 15 in the rubber bumper 7, which makes it more rigid, using a servomotor 16 controlled by the steering unit 6 and controller 13, which is an embodiment form of the invention that is shown in FIG. 3. Accordingly, the threaded rod 14 can also be screwed out of the rubber bumper 7, which results in a softer bumper characteristic.

Figure 4:
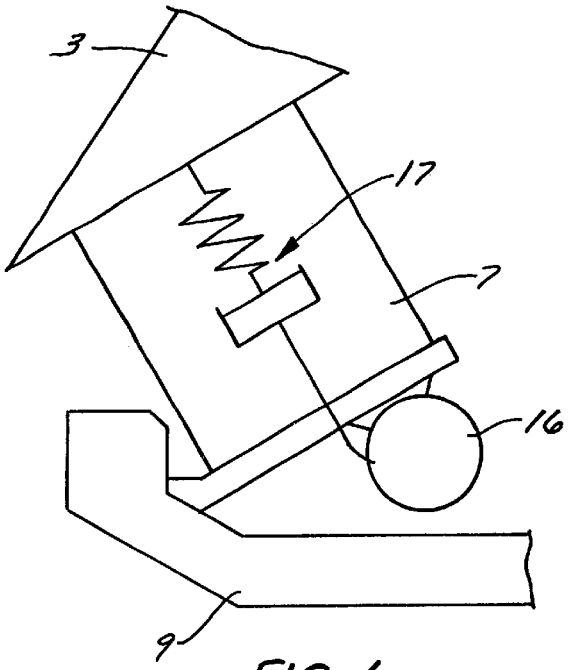
FIG. 4 is a somewhat schematic side sectional elevation view of a damping element constructed in accordance with another embodiment of the invention.

Alternatively, it is also possible to use known oil pressure shock absorbers (not shown) having adjustable orifice cross-sections influenced externally. Furthermore, in another embodiment form of the invention shown in FIG. 4, the coupling point of the rubber bumper 7 can be varied at the lower 8 or upper mass 1, for example by interposing other rubber bumpers or springs 17. The switching is then done either using a servomechanism 16 or an electromagnetic actuator that either completely bypasses the rubber bumper 7 by activating a latch or switches another rubber bumper or spring 17 in.

Also, in another embodiment form of the invention (not shown), the center guide pole is completely eliminated. Instead, remote control system (not shown) is incorporated, which places the user in the position to operate the vibration plate at a distance and thus outside the danger area. Furthermore, the operator is not exposed to any uncomfortable oscillations. However, this does not only have the advantage of an increase in comfort: since the center guide pole and the cost intensive hydraulic system used previously can be eliminated, considerable manufacturing costs can be saved.

I claim:

1. A ground compaction device comprising:

an upper mass, a lower mass with a ground contact plate and an oscillator unit, and at least one spring-damper unit that couples the upper mass to the lower mass at a number of points, wherein the spring parameters and/or damping parameters of the at least one spring-damper unit can be changed by a steering unit operably connected to the at least one spring-damper unit.

2. A ground compaction device according to claim 1, wherein the at least one spring-damper unit has a damping material made of a viscoelectric fluid, and the device includes a controller that is connected between the at least one spring-damper unit and the steering unit and that applies an electrical voltage to the at least one spring-damper unit.

3. A ground compaction device according to claim 2, wherein the electric voltage applied by the controller to the at least one spring-damper unit is changed by the adjustment of the steering unit.

4. A ground compaction device according to claim 1, wherein at least one spring-damper unit has a rubber bumper.

5. A ground compaction device according to claim 4, wherein the device includes a rod that is connected to the at least one spring-damper unit and that can be moved into the rubber bumper or out of the rubber bumper by means of a servomechanism operably connected to the rod and controlled by the steering unit.

6. A ground compaction device according to claim 1, wherein the spring-damper unit whose spring and/or damping parameters can be changed has a number of dampers that can be turned on or off by means of the steering unit through a servomechanism.

7. A ground compaction device comprising:

an upper mass;

a lower mass including a ground contact plate and an oscillator unit;

at least one spring-damper unit that couples the upper mass to the lower mass; and a steering unit that is operably connected to the at least one spring-damper unit and that is selectively operative to change at least one of a spring parameter and a damping parameter of the at least one spring-damper unit.

8. A ground compaction device according to claim 7, wherein the at least one spring-damper unit has a damping material made of a viscoelectric fluid, and further comprising a controller that is connected to the at least one spring-damper unit and the steering unit and that applies an electrical voltage to the at least one spring-damper unit in response to operation of the steering unit.

9. A ground compaction device according to claim 8, further comprising adjusting the steering unit, and wherein the electric voltage applied by the controller to the at least one spring-damper unit is changed by the adjustment of the steering unit.

10. A ground compaction device according to claim 7, wherein the at least one spring-damper unit has a rubber bumper.

11. A ground compaction device according to claim 10, further comprising a rod that is connected to the at least one spring-damper unit, and a servomechanism that is operably connected to the rod and that is controlled by the steering unit to drive the rod into and out of the rubber bumper.

12. A ground compaction device according to claim 7, wherein the at least one spring-damper unit includes a plurality of dampers, and further comprising a servomechanism that is controlled by the steering unit to turn the dampers on and off.

* * * * *